US006566310B2

(12) United States Patent
Chan

(10) Patent No.: US 6,566,310 B2
(45) Date of Patent: May 20, 2003

(54) TANDEM SPACER FLUID SYSTEM AND METHOD FOR POSITIONING A CEMENT SLURRY IN A WELLBORE ANNULUS

(75) Inventor: Albert F. Chan, Plano, TX (US)

(73) Assignee: Atlantic Richfield Company, Lisle, IL (US)

( * ) Notice: Subject to any disclaimer, the term of this patent is extended or adjusted under 35 U.S.C. 154(b) by 92 days.

(21) Appl. No.: 09/907,229

(22) Filed: Jul. 17, 2001

(65) Prior Publication Data

US 2001/0042622 A1 Nov. 22, 2001

Related U.S. Application Data

(62) Division of application No. 09/372,882, filed on Aug. 12, 1999, now Pat. No. 6,283,213.

(51) Int. Cl.[7] ..... C09K 3/00; E21B 33/13

(52) U.S. Cl. ..... 507/211; 507/261; 166/291

(58) Field of Search ..... 166/291; 507/211, 507/261

(56) References Cited

U.S. PATENT DOCUMENTS

| | | | | |
|---|---|---|---|---|
| 3,070,162 | A | 12/1962 | Barnard, Jr. | 166/38 |
| 3,529,666 | A | 9/1970 | Crowe | 166/300 |
| 3,653,441 | A | 4/1972 | Tuttle | 166/291 |
| 3,756,319 | A | 9/1973 | Holm et al. | 166/304 |
| 3,884,302 | A | 5/1975 | Messenger | 166/291 |
| 4,083,407 | A | 4/1978 | Griffin, Jr. et al. | 166/291 |
| 4,176,720 | A | 12/1979 | Wilson | 166/293 |
| 4,216,022 | A | 8/1980 | Wilson | 106/104 |
| 4,217,229 | A | 8/1980 | Watson | 252/8.55 R |
| 4,276,182 | A | 6/1981 | Beirute | 252/8.55 R |
| 4,322,301 | A | 3/1982 | Blackmore | 252/8.5 A |
| 4,342,866 | A | 8/1982 | Kang et al. | 536/119 |
| 4,374,738 | A | 2/1983 | Kelley | 252/8.5 C |
| 4,423,781 | A | 1/1984 | Thomas | 166/312 |
| 4,528,106 | A | 7/1985 | Grolitzer | 252/8.55 D |

(List continued on next page.)

FOREIGN PATENT DOCUMENTS

| | | |
|---|---|---|
| EP | 0 171 999 A2 | 2/1986 |
| EP | 0 271 784 A2 | 12/1987 |
| EP | 0 430 644 A1 | 6/1991 |

OTHER PUBLICATIONS

"Interfacial Tensions and Solubilizing Ability of a Microemulsion Phase That Coexists With Oil and Brine", *Journal of Colloid and Interface Science*, vol. 71, No. 2, Sep. 1979.

SPE 25181 "Surfactants: Additives to Improve the Performance Properties of Cements" by K.M. Cowan, Shell Development Co., and Larry Eoff, Halliburton Services, Society of Petroleum Engineers, Inc., 1993.

"Product Line of Sugar Lipids", *SIMULSOL* SL*, SEPPIC, Inc., 30, Two Bridges Road, suite 225, Fairfield, New Jersey 07006, U.S.A., No date available.

"Alkyl Polyglycosides—Technology, Properties and Applications", edited by K. Hill, W. von Rybinski and G. Stoll; VCH Verlagsgesellschaft mbH, D–69451 Weinheim (Federal Republic of Germany), 1997; pp. 11–12.

Dobson, J.W., Jr. et al., "Development of a Unique Low Solids, High Density Drilling Fluid System", American Association of Drilling Engineers Drilling Fluids Technology Conference (Houston, Apr. 3&4, 1996).

*Primary Examiner*—Philip Tucker
(74) *Attorney, Agent, or Firm*—F. Lindsey Scott

(57) ABSTRACT

A method and a tandem spacer consisting of an aqueous lead spacer fluid and an aqueous tail spacer fluid for displacing a drilling fluid from an annular space in a wellbore with a cement slurry is disclosed. The aqueous lead spacer fluid and the aqueous tail spacer fluid are formulated to minimize mixing between a displaced drilling fluid and a cement slurry and to clean contaminants from the annular space.

5 Claims, 3 Drawing Sheets

U.S. PATENT DOCUMENTS 4,565,647 A 1/1986 Llenado ..... 252/354
4,648,453 A 3/1987 Nagra et al. ..... 166/281
4,681,164 A 7/1987 Stacks ..... 166/304
4,717,488 A 1/1988 Seheult et al. ..... 252/8.551
4,856,589 A 8/1989 Kuhlman et al. ..... 507/211
4,883,125 A 11/1989 Wilson et al. ..... 166/291
4,888,120 A 12/1989 Mueller et al. ..... 252/8.551
4,892,898 A 1/1990 Leighton et al. ..... 147/125
4,915,845 A 4/1990 Leighton et al. ..... 210/701
4,953,620 A 9/1990 Bloys et al. ..... 166/293
4,976,316 A 12/1990 Carpenter et al. ..... 166/291
4,985,154 A 1/1991 Balzer et al. ..... 507/211
5,005,646 A 4/1991 Bloys et al. ..... 166/291
5,027,900 A 7/1991 Wilson ..... 166/285
5,030,366 A 7/1991 Wilson et al. ..... 252/8.551
5,038,863 A 8/1991 Bloys et al. ..... 166/291
5,101,902 A 4/1992 Parcevaux et al. ..... 166/291
5,113,943 A 5/1992 Wilson et al. ..... 166/291
5,164,116 A 11/1992 Berkhof et al. ..... 252/331
5,221,343 A 6/1993 Grauer et al. ..... 106/729
5,221,489 A 6/1993 Bloys et al. ..... 252/8.551
5,287,929 A 2/1994 Bloys et al. ..... 166/291
5,292,367 A 3/1994 Bloys et al. ..... 106/802
5,316,083 A 5/1994 Nahm et al. ..... 166/291
5,360,787 A 11/1994 Bloys et al. ..... 507/124
5,374,361 A 12/1994 Chan ..... 507/211
5,458,197 A 10/1995 Chan ..... 166/304
5,466,746 A 11/1995 Geck et al. ..... 524/837
5,627,144 A 5/1997 Urfer et al. ..... 507/211
5,663,137 A 9/1997 Giesen et al. ..... 510/470
5,789,352 A 8/1998 Carpenter et al. ..... 507/209
5,830,831 A 11/1998 Chan et al. ..... 507/211
5,866,517 A 2/1999 Carpenter et al. ..... 507/226
5,874,386 A 2/1999 Chan et al. ..... 507/211
5,874,387 A 2/1999 Carpenter et al. ..... 507/228
5,977,032 A 11/1999 Chan ..... 507/211
5,996,692 A 12/1999 Chan et al. ..... 166/263
6,000,412 A 12/1999 Chan et al. ..... 134/22.14
6,090,754 A 7/2000 Chan et al. ..... 507/110
6,112,814 A 9/2000 Chan et al. ..... 166/304

TANDEM SPACER FLUID SYSTEM AND METHOD FOR POSITIONING A CEMENT SLURRY IN A WELLBORE ANNULUS

This is a division, of application Ser. No. 09/372,882 filed on Aug. 12, 1999 now U.S. Pat. No. 6,283,213 B1.

BACKGROUND OF THE INVENTION

1. Field of the Invention

This invention relates to the use of tandem spacer fluids between a drilling fluid and a cement slurry during the positioning of a cement slurry in a wellbore annulus by displacement of the drilling fluid with the cement slurry.

2. Background

In rotary drilling of wells a drilling fluid, sometimes referred to as a drilling mud, is circulated downwardly through a pipe, sometimes referred to as a drill string, and back up the annulus between the drill string, and the inside of the wellbore. The drilling fluid may be a water-based drilling fluid or an oil-based drilling fluid. The term oil-based drilling fluid includes drilling fluids having a base comprising a petroleum fraction, a synthetic oil, blends of oils or the like.

The drilling fluid may also include viscosifiers, polymers, starches, gelled mud, oily lubricants and the like. When a casing or liner is to be cemented into the wellbore, any drilling fluid and remnants of the viscosifiers, polymers, starches and other materials present in the wellbore or in the annulus are preferably removed to aid the bonding of the cement between the casing or liner and the wellbore. In removing this drilling fluid from the wellbore and to clean the annulus, a wash or spacer fluid can be introduced ahead of a cement slurry.

Drilling fluids and cement slurries are typically chemically incompatible fluids which undergo severe gelation or flocculation if allowed to come into contact. Thus the drilling fluid and gelled mud, oily lubricants and the like must be removed from the wellbore annulus prior to cement placement in the annulus. Spacer fluids are pumped between the drilling fluid and the cement slurry to form a buffer between the drilling fluid and the cement slurry, clean the annulus and prevent the drilling fluid and the cement slurry from coming into contact.

Spacer fluids should possess certain rheological tendencies which assist in granular solids removal and which encourage removal of the gelled drilling fluid and/or external filter cake from the walls of the well. A common cause of failure in primary cementing is the incomplete displacement of and cleaning to remove drilling fluids, gelled drilling fluid, oily lubricants or other materials which interfere with good cement bonding, which results in the development of mud filled channels in the cement. These mud filled channels may open during well production permitting vertical migration of oil and gas behind the casing.

Conventional spacer fluids are typically composed of an aqueous base fluid and a weighting agent. The weighting agent is included in the composition to increase the density of the spacer fluid to a desired value and to increase the erosion effect of the spacer fluid on the filter cake clinging to the walls of the well.

The fundamental properties of the aqueous base spacer fluid are typically particle stability and suspension (anti-settling properties), fluid-loss control, favorable rheology, and compatibility with drilling fluids and cement slurries. These properties are directly related to the composition of the spacer fluid.

Consequently a conventional aqueous base spacer fluid may include one or more of an anti-settling agent, a fluid-loss controlling agent, a dispersing agent, and a surfactant for obtaining a water wetted surface to aid in cement bonding. The final composition of conventional spacer fluids is typically obtained by adding a weighting agent to the aqueous base spacer fluid to achieve a desired fluid density. The viscosity of the aqueous base spacer fluid is readily adjusted by the use of standard viscosifiers known to those skilled in the art.

The anti-settling agent and fluid-loss controlling agent may comprise a single component of the composition or may comprise a plurality of components of the composition. The component agents typically are soluble or dispersible in water. Dependent upon the water available at the site and in the geological strata encountered in the wellbore, the aqueous base spacer fluid typically includes fresh water, sea water, brine or an aqueous composition containing one or more dissolved salts such as sodium chloride, potassium chloride and ammonium chloride. It is preferred that the spacer fluid retain its above mentioned fundamental properties at all possible salt concentrations. Spacer fluids are conventionally used over a wide temperature range from the surface ambient temperature to the bottom hole circulating temperature in a wellbore. The bottom hole circulating temperature may be 200° C. or higher. The term "anti-settling properties" refers to the capacity of the spacer fluid to keep the weighting agent particles in stable suspension throughout the cementing operation which may typically last from about 1 to about 4 hours or longer. A spacer fluid is considered to have good fluid loss control properties if the fluid loss measured according to API specification 10, Appendix F is less than 100 milliliters/30 minutes and excellent if the fluid loss is less than 50 milliliters/30 minutes. Favorable rheology for a spacer fluid requires that the fluid has minimum friction pressure while maintaining adequate suspension of solids. Since the spacer fluid is to be pumped between the drilling fluid and the cement slurry for removing and replacing the drilling fluid in the well annulus, it is very important that the spacer fluid be as compatible as possible with both the drilling fluid and the cement slurry.

The compatibility of a spacer fluid with a drilling fluid and a cement slurry is determined in the laboratory by studying the viscosity of binary or ternary mixtures of spacer fluid with the drilling fluid, cement slurry, or both, varying over the range of 0 to 100 percent by volume for each component of the mixture. Such compatibility in the past has been difficult to obtain primarily because the drilling fluid and the cement slurry are incompatible fluids.

The compatibility of the spacer fluid with the drilling fluid and the cement slurry is considered to be excellent if the viscosity of a mixture of the spacer fluid and the drilling fluid or the cement slurry at a given shear rate and temperature is equal to or less than the viscosity of the more viscous component of the mixture at the same shear rate and temperature. Likewise, the viscosity of a mixture of all three components is considered to excellent if it is less than or equal to the viscosity of the most viscous component at the same shear rate and temperature.

Conventional spacer fluid compositions do not usually demonstrate good compatibility with mixtures of drilling fluids and cement slurries while simultaneously possessing good rheological fluid loss control and anti-settling properties over the entire range of shear rates and temperatures normally encountered in oil field services.

Further conventional spacer fluids have been found to mix with the cement slurries and drilling fluid during displacement at a rapid rate when the density of the cement slurry and the spacer fluid differ by more than about 1.5 pounds per gallon (ppg), when the density of the spacer fluid and the drilling fluid differ by more than 1.5 ppg or where both conditions exist. As previously noted, it is undesirable that the cement slurry and the drilling fluid mix during displacement and positioning. Attempts to avoid such mixing by using a spacer fluid having a density equal to the average density of the cement slurry and the drilling fluid have not been successful to avoid such mixing when the density difference between the density of the spacer fluid and either or both of the cement slurry and the drilling fluid is greater than 1.5 ppg.

Spacer fluids using sulfonated styrene-maleic anhydride copolymer (SSMA) have previously been used. Such spacer fluids are disclosed in U.S. Pat. No. 5,030,366 "Spacer Fluids" issued Jul. 9, 1991 to Wilson et al; U.S. Pat. No. 5,113,943 "Spacer Fluids" issued May 19, 1992 to Wilson et al; and U.S. Pat. No. 5,292,367 "Dispersant Compositions for Subterranean Well Drilling and Completion", issued Mar. 8, 1994 to Bloys et al. These patents disclose spacer fluids containing dispersing materials which have many of the desired properties of spacer fluids. These patents are hereby incorporated in their entirety by reference.

Spacer fluids such as those described above have been disclosed in U.S. Pat. No. 5,866,517 "Method and Spacer Fluid Composition for Displacing Drilling Fluid From a Wellbore", issued Feb. 2, 1999 to Robert B. Carpenter and David L. Johnson. This patent is hereby incorporated in its entirety by reference.

Other useful dispersants are disclosed in U.S. Pat. No. 5,874,387 "Method and Cement-Drilling Fluid Cement Composition for Cementing a Wellbore", issued Feb. 23, 1999 to Robert B. Carpenter and David L. Johnson. This patent is incorporated in its entirety by reference.

In U.S. Pat. No. 5,866,517, conventional spacer fluids are described. As noted in this reference, in conventional spacer fluids it is very undesirable that the cement slurry and drilling fluids come in contact since they are basically incompatible materials. This difficulty is addressed in U.S. Pat. No. 5,866,517 by the use of a dispersant which renders the cement slurry and the drilling fluids compatible. This compatibility then minimizes the difficulties created by mixing of the cement slurry and the drilling fluids. While this approach is effective, it is desirable to avoid mixing of the cement slurry and the drilling fluids during the displacement and positioning of the cement in the annular space in the wellbore.

It is also highly desirable that the surfaces of the inside of the wellbore and the outside of the well casing which form the annular space be cleaned of the drilling fluid, gelled drilling fluid, oily lubricants and the like, when water based drilling fluids are used, and of oily residues and the like when an oil-based drilling fluid is used, so that good cement bonding can be achieved and so that the cement can be sealingly positioned in the annular space. While some aqueous base spacer fluids have included some surfactants, little attention has been directed to the formulation of specific surfactant formulations to ensure good cleaning.

SUMMARY OF THE INVENTION

According to the present invention it has now been found that improved cement positioning is achieved by a method for displacing a drilling fluid from an annular space between the inner surface of a wellbore and the outer surface of a casing positioned in the wellbore with a cement slurry and positioning the cement slurry in the annular space by injecting, between the drilling fluid and the cement slurry, a spacer fluid system consisting essentially of an aqueous lead spacer fluid having a density equal to or up to 2.0 ppg greater than the density of the drilling fluid and containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 90 to about 10 mole percent of at least one ethoxylated alcohol containing alkyl alcohols containing from about 6 to about 16 carbon atoms and from about 2 to about 8 ethylene oxide groups per molecule of monofunctional alkyl alcohol; and, an aqueous tail spacer fluid having a density equal to or greater than the lead spacer fluid and equal to or up to 2.0 ppg less than the density of the cement slurry and containing from about 0 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of at least one ethoxylated alcohol containing alkyl alcohols containing from about 6 to about 16 carbon atoms and from about 2 to about 8 ethylene oxide groups per molecule of alkyl alcohol.

The present invention also comprises a tandem spacer fluid system for use between a drilling fluid and a cement slurry wherein the spacer fluid consists essentially of an aqueous lead spacer fluid having a density equal to or greater than the density of the drilling fluid and containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 60 to about 10 mole percent ethoxylated alcohol containing alkyl alcohols containing from about 6 to about 16 carbon atoms and from about 2 to about 8 ethylene oxide groups per molecule of monofunctional alkyl alcohol; and, an aqueous tail spacer fluid having a density greater than the lead spacer fluid and equal to or up to 1.5 ppg less than the density of the cement slurry and containing from about 0 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of ethoxylated alcohol containing monofunctional alkyl alcohols containing from about 6 to about 16 carbon atoms and from about 2 to about 8 ethylene oxide groups per molecule of monofunctional alkyl alcohol.

In a further embodiment of the present invention, the tandem spacer system may comprise a first fluid spacer consisting essentially of an aqueous fluid containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 90 to about 10 mole percent of ethoxylated alcohol containing alkyl alcohols containing from about 6 to about 16 carbon atoms and from about 2 to about 8 ethylene oxide groups per molecule of monofunctional alkyl alcohol, and a second fluid spacer consisting essentially of an aqueous fluid containing from about 0 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of ethoxylated alcohol containing alkyl alcohols containing from about 6 to about 16 carbon atoms and from about 2 to about 8 ethylene oxide groups per molecule of monofunctional alkyl alcohol for use in wells where there is little density difference between the cement slurry and the drilling fluid or where plugs can be used to separate at least one of the aqueous lead spacer fluid and the drilling fluid, and the aqueous tail spacer fluid and the cement slurry.

DESCRIPTION OF THE PREFERRED EMBODIMENTS

The failure to perform an effective cleanout during the positioning of a cement slurry in the annular space between the outside of a wellbore casing and the inside surface of the wellbore may result in a failure to establish a bond between the cement and the wellbore or a casing or tubing. Such failures can result in expensive well work-overs and other treatments to prevent the leakage of fluids along the length of the casing or the wellbore through passages between the wellbore or the casing and the cement.

To avoid these problems, aqueous spacer fluids are frequently used. Such spacer fluids are well known to those skilled in the art and have, in many instances, contained surfactants, although the primary emphasis in the spacer fluids has been their function as a spacer fluid rather than as a fluid for cleaning the wellbore.

According to the present invention wellbores are more effectively cleaned by the use of a tandem spacer fluid system which contains a tailored mixture of surfactant components in the lead and in the tail spacer fluids. These surfactant components are alkyl polyglycoside surfactants and ethoxylated alcohol surfactants. Either or both of the lead and the tail spacer may contain dispersants such as those disclosed in U.S. Pat. Nos. 5,030,366; 5,113,943; 5,292,367 and 5,874,387.

U.S. Pat. No. 5,374,361, issued Dec. 20, 1994 to Albert F. Chan and is directed to providing an improved method of removing oil-based material from a wellbore using a composition containing an alkyl polyglycoside surfactant which comprises 1% to 10% by weight of the composition and with a co-surfactant selected from a group consisting of linear alkyl ethoxylate and alkyl phenol ethoxylate. U.S. Pat. No. 5,458,197, issued Oct. 17, 1995 to Albert F. Chan, is directed to improved clean-out systems for wellbores using alkyl polyglycoside surfactants. Both of these patents are hereby incorporated in their entirety by reference.

U.S. Pat. No. 5,830,831, issued Nov. 3, 1998 to Albert F. Chan, discloses a method for cleaning oil-based contaminants from a wellbore using a surfactant composition consisting essentially of an alkyl polyglycoside and a linear ethoxylated alcohol, as well as methods for conducting acidizing operations using alkyl polyglycosides, a method for improving the wetting action and hydration of cementitious materials by the use of alkyl polyglycosides and a method for improving cement bonding in a well including the use of alkyl polyglycosides mixed with a cement composition. This patent is hereby incorporated in its entirety by reference.

Figure 1:
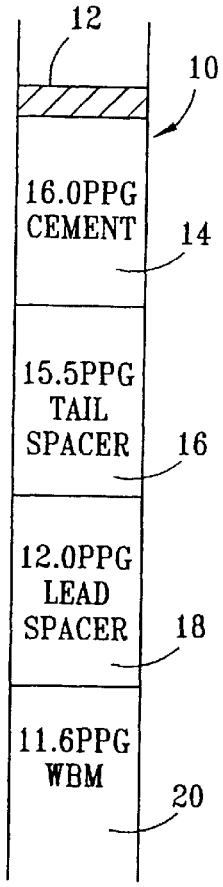
FIG. 1 is a diagram of a tandem spacer fluid system according to the present invention with a water-based drilling fluid.

Alkyl polyglycosides are known to have desirable properties for use in cleaning wellbore surfaces. Notwithstanding these desirable properties, it has been found that even when alkyl polyglycoside surfactants are used in aqueous spacers that, as a result of the substantial density difference between the cement slurry and the drilling fluids, undesirable mixing still may occur to a high degree. For instance, when the spacer fluid has a density more than 1.5 ppg less than the cement slurry or more than 1.5 ppg greater than the drilling fluid, or both, undesirable mixing occurs as the drilling fluid is displaced. As shown in FIG. 1, in a section 10 of a wellbore, a cement slurry 14 is positioned above a tail spacer 16, a lead spacer 18 and a water-based mud drilling fluid 20. A plug 12 is positioned above the cement which has a density of 16.0 ppg. Tail spacer 16, having a density of 15.5 ppg, is placed directly beneath cement slurry 14 with lead spacer 18 having a density of 12.0 ppg being placed ahead of tail spacer 16. Water-based drilling fluid 20, having a density of 11.6 ppg, is positioned beneath lead spacer 18. As these fluids are injected downwardly through the wellbore 10, mixing is greatly reduced by the use of a tail spacer having a density no more than 1.5 ppg less than the cement slurry. Similarly, the lead spacer has a density no more than 1.5 ppg more than the water-based drilling fluid. The difference of 3.5 ppg at the interface between the tail spacer and the lead spacer may result in some mixing at this interface, but mixing at this interface is not a problem since it simply results in a smoother blending of the densities of the tail spacer and the lead spacer and some mixing between the tail spacer and the lead spacer. Mixing between the cement slurry and the tail spacer and mixing between the drilling fluid and the lead spacer is minimized because of the reduced difference in densities between the materials at the interfaces. It is also desirable that the viscosity of the lead spacer is greater than that of the drilling fluid, with the viscosity of the tail spacer being greater than that of the lead spacer and the density of the cement slurry being greater than the density of the tail spacer.

Figure 2:
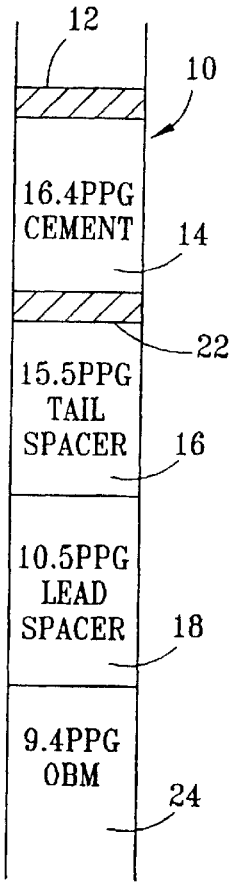
FIG. 2 is a diagram of a tandem spacer fluid system according to the present invention with an oil-based drilling fluid.

Similarly, in FIG. 2 a system is shown for an oil-based mud drilling fluid. Two plugs are shown for maintaining separation between the fluids used to push the cement slurry downwardly in the well and between the cement slurry and the tail spacer. The use of such plugs is well known to those skilled in the art and these plugs may be used to separate the liquid layers. The use of these plugs can achieve separation of the layers as they pass downwardly through the well, but they are necessarily ruptured (except for plug 12 above the cement) at the bottom of the well casing. Accordingly, there is no plug separation between the fluids as they move upwardly through the annulus around the outside of the casing. By the use of the tandem spacer system of the present invention, mixing between the cement slurry and the drilling fluid is greatly reduced. This mixing is undesirable in that it reduces the effectiveness of the well clean-out and the like. The use of dispersants as disclosed in U.S. Pat. No. 5,866,517 is one solution to this problem, especially in the case of water-based drilling fluids.

The difficulty in maintaining the integrity of the spacer fluid during the injection is a result of the density and viscosity differences between the cement slurry and the drilling fluid. The cement slurry has a density which may range from about 12.3 to about 18 ppg, and may typically be a 16.4 ppg cement slurry. The drilling fluid typically has a much lower density from about 9 to about 18 ppg. When this difference is greater than about 6 ppg, it is difficult to avoid gravitational mixing of the drilling fluid and the cement during injection even when a spacer fluid is used because of the considerable differences in specific gravity. Previously it has been attempted to resolve this difference by using a spacer fluid having a specific gravity intermediate the density of the cement slurry and the drilling fluid. The use of such mixtures has not been effective when the difference in density is greater than about 6 ppg.

According to the present invention, a lead spacer fluid is first injected directly behind the drilling fluid and consists of an aqueous spacer fluid having a density greater than or equal to the density of the drilling fluid and a viscosity greater than the drilling fluid and containing from about 0.5 to about 10, and preferably from about 0.5 to about 5.0, weight percent of a surfactant consisting essentially of from about 10 to about 90, and preferably about 30 to about 80, mole percent of at least one alkyl polyglycoside containing alkyl groups containing from about 4 to about 20 carbon atoms and having an oligomerization number from 1 to about 12 and from about 90 to about 10, and preferably from about 70 to about 20, mole percent of at least one ethoxylated alcohol containing alkyl alcohols containing from about 6 to about 16 carbon atoms and from about 2 to about 8 ethylene oxide groups per molecule of alkyl alcohol and by injecting an aqueous tail spacer fluid having a density equal to or greater than the lead spacer fluid and less than the density of the cement slurry and containing from about 0 to about 10 weight percent of a surfactant consisting essentially of from about 30 to about 100, and preferably about 90 to about 10, mole percent of at least one alkyl polyglycoside containing alkyl groups containing from about 4 to about 20 carbon atoms and having an oligomerization number from about 1 to about 12 and up to about 70, and preferably from about 10 to about 80 mole percent of at least one ethoxylated alcohol containing alkyl alcohols containing from about 6 to about 16 carbon atoms and from about 2 to about 8 ethylene oxide groups per molecule of alkyl alcohol.

Desirably, the aqueous lead spacer fluid has a density from about 0.1 to about 2.0 ppg, and preferably from about 0.1 to about 1.0 ppg, greater than the density of the drilling fluid. Preferably, the difference is from about 0.5 to about 1.0 ppg. Similarly, the tail spacer fluid which contacts the lead spacer fluid and the cement slurry has a density from about 0.1 to about 2.0 ppg, and preferably from about 0.1 to about 1.0 ppg, less than the density of the cement slurry. Desirably this difference is from about 0.5 to about 1.0 ppg. With this limited differential density, a much reduced mixing of the drilling fluid and the lead spacer fluid and of the cement slurry and the tail spacer fluid occurs. Mixing may occur at the interface between the lead spacer fluid and the tail spacer fluid, but mixing at this interface is less objectionable, since they are fluids of similar characteristics and the mixture at interface may provide a controlled density transition to facilitate an effective dispersant. The use of the lead spacer fluid in combination with the tail spacer fluid not only results in improved separation of the cement slurry and the drilling fluid during injection, but also provides an optimum cleaning performance for a wide range of temperature variations in the drill pipe and in the annulus. Desirably, the spacer fluid is used in an amount sufficient to occupy a length of at least 600 feet of the casing during injection, or to provide a surface contact time in the drill pipe, wellbore and the annulus of at least 5 minutes, whichever is greater.

As well known to those skilled in the art, during injection the spacer fluid is injected into the casing filled with drilling fluid and pushes the drilling fluid downwardly in the casing and upwardly around the casing and through the annular space between the outside of the casing and the inside of the wellbore. The cement slurry is injected into the casing behind the spacer fluid and pushes the spacer fluid and drilling fluid downwardly in the casing. A chaser fluid which may be any suitable material, including brine, seawater, drilling mud and the like is injected above the cement slurry and a plug in an amount sufficient to push the cement downwardly through the casing and upwardly into the annular space to fill a selected portion of the annular space.

By the method of the present invention, a much improved separation of the cement slurry and the drilling fluid is achieved.

According to the present invention, the spacer fluid system is designed to provide not only a balanced displacement of drilling fluid and cement slurry, but also efficient cleaning of the drill pipe or casing and formation surfaces in the annulus which may be contaminated with oily lubricant commonly used in water-based drilling muds and any gel water-based mud residue. For oil-based muds, the cleaning of emulsified oily components from the casing and from the formation surfaces in the annulus is of primary concern. For water-based mud applications, the cleaning of the surfaces is accomplished by the use of a powerful dispersant and an effective surfactant blended for wetting. In the oil-based mud application, the removal of residual oil-based mud and emulsified oil is the primary concern in the design of the surfactant blend. According to the present invention, the lead spacer allows the design of the surfactant blend to be optimized for the clean-up of the upper hole section where the temperature is comparatively lower. The tail spacer is designed to optimize the surfactant blend for cleaning in the bottom hole section where the temperature is typically much higher.

An efficient clean-out of both the upper and the lower sections of the casing and annulus is necessary to provide for a clean passage of the cement slurry for placement in the annular section.

The compositions in accordance with the present invention exhibit a Winsor Type III or so-called middle-phase microemulsion upon contact with the oil-based contaminants which actually expands its breadth, as a function of HLB (hydrophile-lipophile balance) number with increasing temperature rather than decreasing in breadth. Winsor Type III or middle-phase microemulsions are discussed in more detail in "Micellization, Solubilization, and Mircoemulsions", Volume 2, K. L. Mittal, Plenum Press, New York, 1977.

The aqueous tail spacer fluid is also designed to clean the bottom hole space. Accordingly, the fraction of low HLB ethoxylated alcohol used in the aqueous tail spacer is less than that in the lead spacer. The lead spacer by contrast contains more of the higher HLB alkyl polyglycoside surfactants.

Figure 3:
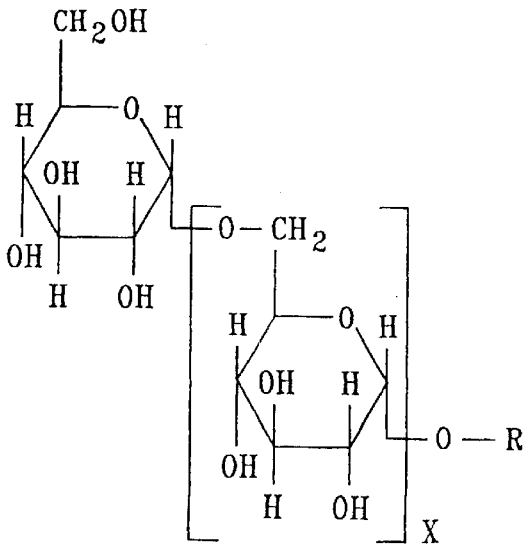
FIG. 3 PRIOR ART
FIG. 3 is a diagram of the molecular structure of an alkyl polyglycoside.

Alkyl polyglycoside surfactants consist of a polar glucose head and an organic carbon chain off of the hemiacetal linkage. A representation of the molecule is shown in FIG. 3. There are two ether oxygens and three hydroxyl groups per glucose unit, plus a terminal hydroxyl group. The lipophilic portion of the molecule resides in the alkyl chain R. R can be a linear or branched alkyl chain containing from 4 to 20 carbon atoms. The polymerization reaction can provide oligomer distributions from x=0 to x=11.

Ethoxylated alcohol surfactants are sensitive to large temperature gradients as normally encountered in wellbore operations, and they are subject to a narrowing of the Windsor type III microemulsion range and become more oil soluble and oil-like as temperature increases from the surface ambient temperature to the bottom hole temperature (for example, 60° F. to about 350° F.), thus making the optimization of the surfactant composition for cleaning very difficult. On the other hand, nonionic alkyl polyglycoside surfactants have no cloud point limitation as do ethoxylated alcohols. In this regard surfactant solutions which comprise substantially nonionic ethoxylated alcohols alone have not been highly successful in completely cleaning out a wellbore to remove oil based drilling fluids as well as hydrocarbon based pipe sealants and lubricants which remain in a well in significant quantities upon completion of the installation of the casing as well as the production or working tubing strings.

Figure 4:
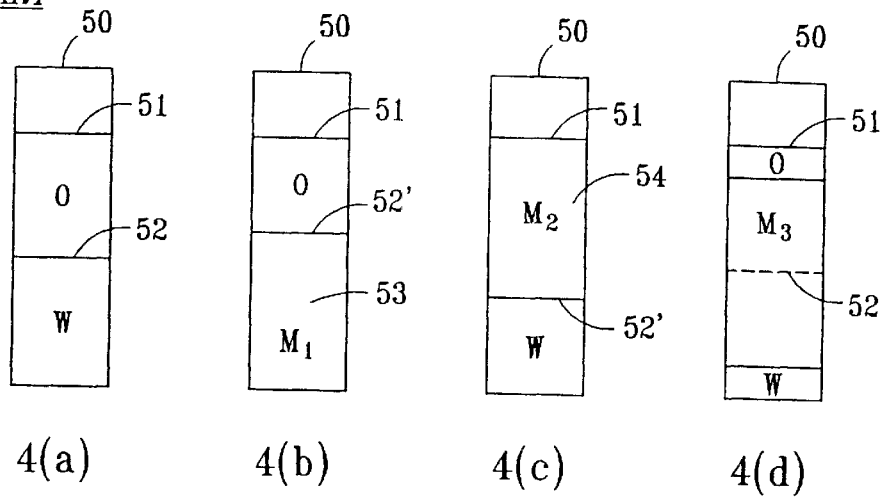
FIG. 4 PRIOR ART
FIG. 4 shows four oil/water systems including Type I, Type II and Type III of Winsor's microemulsions.

In FIG. 4 Type I, Type II and Type III microemulsions are shown. FIG. 4(*a*) shows oil (o) and water (w) containing surfactants in a container 50 to a level 51 and having an interface 52. In FIG. 4(*b*) a Type I microemulsion 53 ($M_1$) which is an oil-in-water microemulsion is shown below an excess oil layer. Such microemulsions are water soluble and contain quantities of solubilized oil as shown by the level of the new interface 52' which is above the original interface 52. In FIG. 4(*c*) a Type II microemulsion 54 ($M_2$) which is a water-in-oil microemulsion is shown above an excess water layer. Such microemulsions are oil soluble and contain quantities of solubilized water as shown by the level of new interface 52' which is below the original interface 52. FIG. 4(*d*) shows a Type III microemulsion 55 ($M_3$) which is located between the oil and water phases and extends above and below original interface 52. Such Type III microemulsions are preferred for wellbore operations since their interfacial tensions and solubilization properties toward both oil and/or water are most desirable and efficient in the removal of both from the wellbore during cleaning operations.

The alkyl polyglycosides used contain alkyl groups containing from about 4 to about 20 atoms and preferably from about 8 to about 16 carbon atoms. The alkyl polyglycosides typically comprise a blend of 2 or more alkyl polyglycoside surfactants. The surfactants may vary over a wide range and may include an alkyl polyglycoside containing alkyl groups having a relatively low number of carbon atoms in combination with alkyl polyglycosides having a relatively high number of carbon atoms in the alkyl group. This combination may be used to achieve particularly desirable solubilization and cleaning properties in a wide range of wellbore environments. Further, the alkyl polyglycosides may comprise a mixture of alkyl polyglycosides containing odd numbered carbon atom containing alkyl groups with alkyl glycosides containing even numbered alkyl polyglycoside groups. The alkyl polyglycosides may be blended to produce an alkyl polyglycoside surfactant having an HLB number (hydrophile-lipophile balance) from about 11.3 to about 12.8.

It is contemplated that a surfactant composition having a blend of at least two alkyl polyglycoside surfactants wherein the total concentration of the surfactant in an aqueous solution is about 0.5% to 10% by weight, will be capable of forming a Winsor Type III microemulsion in a temperature range of about 80° F. to 350° F. The total concentration of surfactant as well as the blend of alkyl polyglycoside surfactants will be dependent on the concentration of oil based material to be removed from the site being treated.

The alkyl polyglycoside component surfactant may comprise a blend of two alkyl polyglycoside surfactants capable of forming a Winsor Type III microemulsion in specific oil/water systems. The blend of the two surfactants may be tailored to the need for wettability versus microemulsification. The HLB number may be modified by blending the two alkyl polyglycoside surfactants in proportions which will give the desired HLB. For example, a mixture of 50 mole percent of an alkyl polyglycoside surfactant having an alkyl chain length of $C_{11}$ and an HLB of 12.4 with an alkyl polyglycoside having an alkyl chain length of $C_{12}$–$C_{16}$ and an HLB of 11.7 would yield a composition with an HLB of 12.06. Such a composition will produce a microemulsion with good solubilization parameter values over a broad range of temperatures. An HLB range that provides an optimum Winsor Type III microemulsion may then be selected and the surfactant blend quantities adjusted accordingly.

The two alkyl polyglycoside surfactants consist of a first alkyl polyglycoside selected from the group consisting of alkyl polyglycosides containing alkyl groups containing an odd number of carbon atoms from 9 to 13 with an oligomer distribution from 1 to 12 and a second alkyl polyglycoside surfactant selected from the group consisting of alkyl polyglycosides containing alkyl groups containing an even number of carbon atoms from 8 to 18 carbon atoms and having an oligomer distribution from 1 to 12. Preferably the surfactant mixture contains from about 10 to about 90 mole percent of the first surfactant and from about 10 to about 90 mole percent of the second surfactant. The second surfactant contains alkyl groups containing even numbers of carbon atoms within the range from 8 to 18 carbon atoms, and preferably from about 12 to about 18 carbon atoms, and more preferably from 12 to 16 carbon atoms. Preferably the second surfactant contains from about 50 to about 75 weight percent alkyl polyglycosides containing 12 carbon atoms.

The first surfactant consists essentially of alkyl polyglycosides containing alkyl groups containing odd numbers of carbon atoms from 9 to 11 carbon atoms. The alkyl groups containing odd numbers of carbon atoms are produced by petroleum refining or other like operations and are typically branched alkyl carbon chains. The production of alkyl polyglycosides containing alkyl groups containing odd numbers of carbon atoms is increasingly difficult and increasingly expensive for alkyls containing 13 or more carbon atoms.

The lower pour points of the alkyl polyglycosides containing alkyl groups containing odd numbers of carbon atoms by comparison to the pour points of the alkyl polyglycosides containing alkyl groups containing even numbers of carbon atoms is illustrated by a comparison of the pour points of alkyl polyglycosides containing alkyl groups containing 10, 11 and 12 carbon atoms, the pour points are as follows: $C_{10}$: 10–15° C.; $C_{11}$: 0–5° C.; and $C_{12}$: 25° C. Note that the pour points for the $C_{10}$ and $C_{12}$ alkyl polyglycosides are significantly higher than the pour point for the $C_{11}$ alkyl polyglycoside.

Preferably, the first surfactant consists essentially of alkyl polyglycosides containing alkyl groups which contain 11 carbon atoms.

The alkyl polyglycosides used as the second surfactant are more readily available commercially. The even numbered alkyl groups are representative of naturally occurring alkyl groups. The alkyl polyglycosides containing alkyl groups containing even numbers of carbon atoms are more viscous and have higher pour points than the alkyl polyglycosides containing alkyl groups containing odd numbers of carbon atoms in a comparable carbon atom range. Alkyl polyglycosides containing longer and even numbered alkyl groups have high pour points and may be solid or semi-solid alkyl polyglycosides at room temperature. Accordingly, from about 10 to about 90 mole percent of the first surfactant is preferably used in the surfactant compositions to provide the desired blends with a suitable viscosity for mixing the surfactants and for ease of handling as blended.

The ethoxylated alcohols contain alkyl alcohols containing from 6 to 16 carbon atoms. Typically, the alkyl alcohols contain from about 2 to about 8 ethylene oxide groups per molecule of alcohol. Preferably the alcohols contain from about 2.5 to 4 ethylene oxide groups per molecule of alcohol and the alcohols are preferably selected from a group consisting of alkyl alcohols containing from about 6 to about 14 carbon atoms with the desired range being from about 8 to about 12 carbon atoms, especially with branched chain alkyl alcohols. Mixtures of ethoxylated alcohols may be used.

Desirably, the surfactant is present in the aqueous lead spacer fluid in an amount equal to from about 0.5 to about 10 weight percent based upon the weight of the aqueous solution. Preferably, the surfactant is present in an amount equal to from about 0.5 to about 5.0 weight percent.

Similarly, the surfactant is desirably present in the aqueous tail spacer fluid in an amount of from about 0 to about 10 weight percent with a preferred range being from about 0.5 to about 5.0 weight percent.

Figure 5:
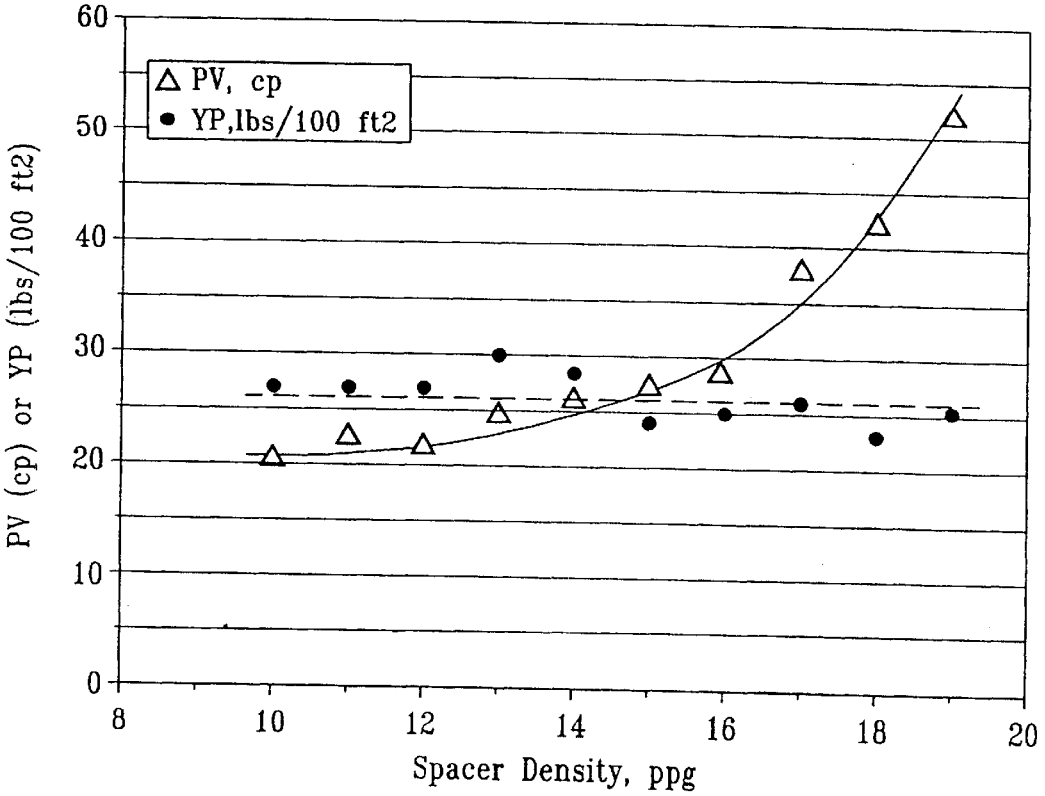
FIG. 5 shows the change in viscosity and yield point of a typical spacer fluid.

The viscosity of the spacer fluids is typically from about 10 to about 45 centipoise (cp). The viscosity of the spacer fluid may be varied by the addition of materials such as barite. In FIG. 5 a curve showing the change in viscosity as a function of spacer density is shown. The viscosity was varied by adding Barite to a spacer fluid.

FIG. 5 also shows the yield point (YP) variation as a function of spacer fluid density. The yield point remains relatively constant since the yield point is a function of the composition of the spacer fluid and can be varied by the addition of materials such as biozan, bentonite, sulfonated styrene maleic anhydride and the like as known to the art.

The viscosity and the yield points of the spacer fluids may be varied by adjustment of the composition of the spacer fluids.

Desirably, the viscosity of the lead spacer fluid is greater than the viscosity of the drilling fluid, with the viscosity of the tail spacer fluid being greater than the lead spacer fluid, but less than the viscosity of the cement slurry. Similarly, the yield points of the cement slurry, tail spacer fluid, lead spacer fluid and drilling fluid preferably decrease in the order listed.

By the use of the lead and tail spacers having viscosities and yield points as discussed above, a good sweep is achieved by the piston-like movement of the spacer fluids through the casing or other pipe and through the annulus.

As noted previously, the control of the viscosity and the yield points of the cement slurry and of the spacer fluid are readily accomplished by means well known to those skilled in the art.

The present invention includes a tandem spacer fluid comprising a spacer fluid for use between a drilling fluid and a cement slurry, the spacer fluid consisting essentially of an aqueous lead spacer fluid having a density greater than the density of the drilling fluid and a viscosity greater than or equal to the drilling fluid and containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 60 to about 10 mole percent of at least one ethoxylated alcohol containing alkyl alcohols containing from about 6 to about 16 carbon atoms and from about 2 to about 8 ethylene oxide groups per molecule of alkyl alcohol; and, an aqueous tail spacer fluid having a density greater than the lead spacer fluid and less than the density of the cement slurry and containing from about 0 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of ethoxylated alcohol containing monofunctional allyl alcohols containing from about 6 to about 16 carbon atoms and from about 2 to about 8 ethylene oxide groups per molecule of monofunctional alkyl alcohol.

This tandem spacer fluid is readily tailored as discussed above to achieve enhanced separation of the drilling fluid and cement slurry while effectively cleaning the drill pipe inner surfaces and the annular space so that the cement slurry is protected from contamination during transport and subsequently positioned in the annular space.

The cement is readily positioned by a method consisting essentially of injecting a tandem spacer fluid system consisting essentially of an aqueous lead spacer fluid having a density greater than the density of the drilling fluid and a viscosity greater than or equal to the drilling fluid and containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 90 to about 10 mole percent of at least one ethoxylated alcohol containing monofunctional alkyl alcohols containing from about 6 to about 16 carbon atoms and from about 2 to about 8 ethylene oxide groups per molecule of monofunctional alkyl alcohol; and, an aqueous tail spacer fluid having a density and viscosity less than the density of the cement slurry and containing from about 0 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of at least one ethoxylated alcohol containing monofunctional alkyl alcohols containing from about 6 to about 16 carbon atoms and from about 2 to about 8 ethylene oxide groups per molecule of monofunctional alkyl alcohol; injecting the cement slurry; and injecting a chaser fluid in an amount sufficient to displace the drilling fluid and the spacer fluid and at least a portion of the cement slurry from the casing and fill a selected portion of the annular space with the cement slurry.

Figure 6:
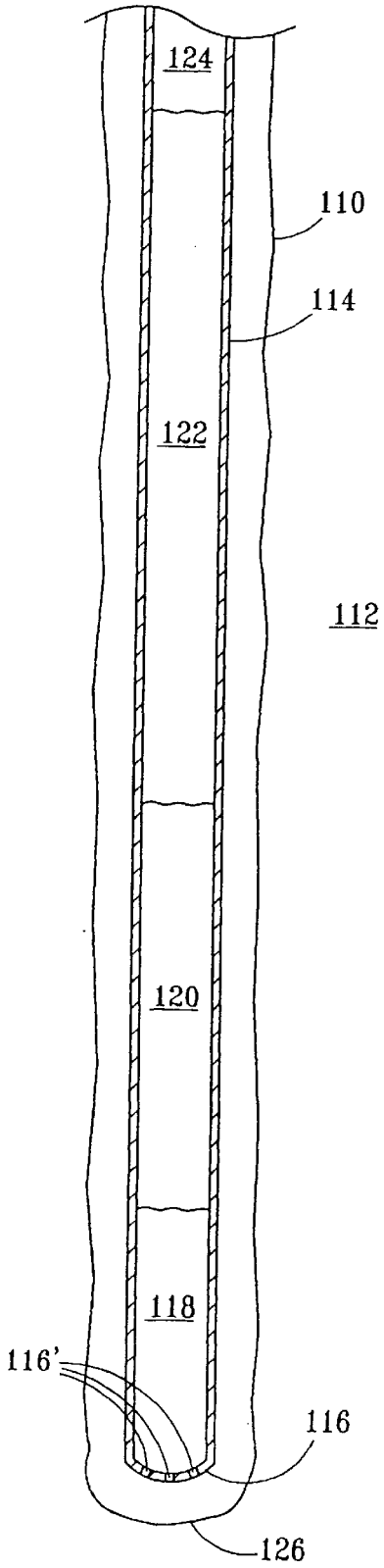
FIG. 6 is a schematic diagram of an embodiment of a wellbore containing drilling fluid, a spacer fluid and a cement slurry as conventionally used in the positioning of a cement slurry in an annulus between the outside of the casing and the inside of the wellbore.

This method is illustrated by reference to FIG. 6 and FIG. 7. In FIG. 6 a wellbore 110 penetrating a formation 112 includes a casing 114. As shown, drilling fluid 118 is positioned in a lower portion of casing 114 and in an annular space between the outside of casing 114 and the inside of wellbore 110. A suitable device 116 (casing shoe) is shown at the bottom of casing 114 and includes openings 116' for evenly distributing flow out of the bottom of casing 114 into a bottom 126 of wellbore 110. A spacer fluid 120 is shown above drilling fluid 118 in casing 114 with a cement slurry 122 being shown above spacer fluid 120 in casing 114. A chaser fluid 124 is shown in casing 114 above a top solid cement plug 125 above the cement slurry 122. In the operation of the method according to the prior art, increased quantities of chaser fluid 124 are injected to push plug 125 and cement slurry 122 downwardly in casing 114 until plug 25 is latched and stopped at 60–120' above the casing shoe 116. The cement slurry 122 ultimately forces drilling fluid 118 and spacer fluid 120 through openings 116' and into the annular space until cement slurry 122 is ultimately positioned in the annular space. At that point, injection is stopped and cement slurry 122 is allowed to set up in the annular space to sealingly close the annular space. Such techniques are considered to be well known to those skilled in the art.

Figure 7:
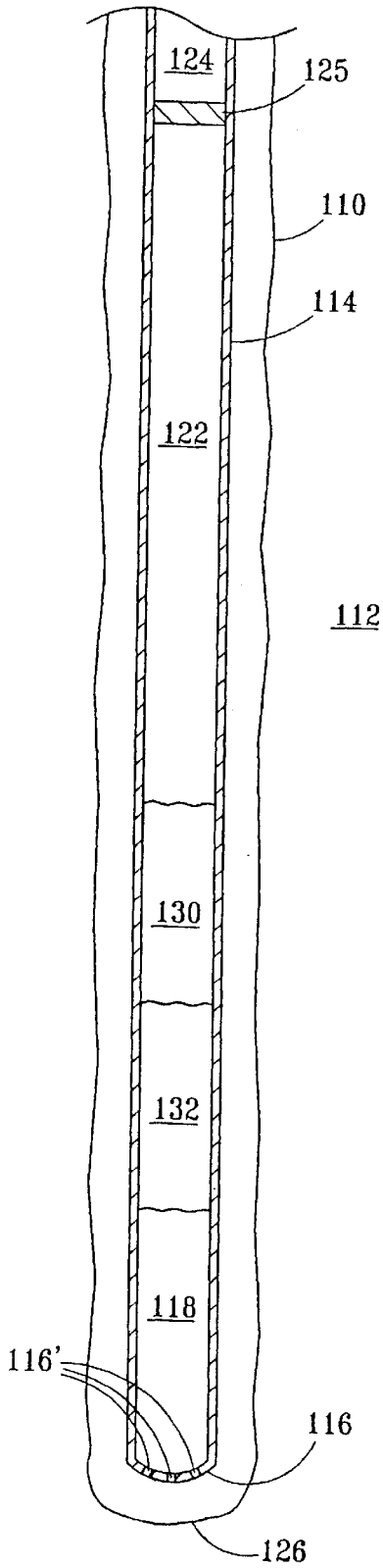
FIG. 7 is a schematic diagram of an embodiment of a wellbore including drilling fluid, a spacer fluid and a cement slurry, according to the method of the present invention.

In FIG. 7, an embodiment of the present invention is shown. Spacer fluid 120 is shown as a tandem spacer system comprising an aqueous lead spacer fluid 132 and an aqueous tail spacer fluid 130. The method is practiced as before except that, with the tandem spacer system, a more effective displacement is obtained due to less mixing of the cement slurry and the drilling fluid. It is desirable that the spacer fluid occupy about 600 to about 1000 feet of annulus volume, or alternatively about 600 to about 1000 feet of casing volume, which may be more readily determined between the drilling fluid and the cement slurry, or provide at least about 5 minutes of surface contact time with the spacer fluid. The method of the present invention is particularly effective for the removal of oil-based drilling fluids. It is desirable, if adequate information with respect to the materials in the annular space is known, to tailor one or both of the lead aqueous spacer fluid and the aqueous tail spacer fluid to form Winsor Type III microemulsions in the annular space. This results in optimum cleaning.

It may be unnecessary to adjust the density and viscosity of the aqueous lead spacer fluid and the aqueous tail spacer fluid if cement wiper plugs are used between the aqueous lead spacer fluid and the drilling fluid and between the aqueous tail spacer fluid and the cement slurry. Similarly, a plug may be used between the aqueous tail spacer fluid and the cement slurry. A solid wiper plug is usually used between the chaser fluid and the cement slurry. Typically, rupturable plugs are used to separate the spacer fluid and the drilling fluid and to separate the cement slurry and the spacer fluid. Plugs may be used for either or both separations, as desired. In any event, these plugs are typically rupturable plugs which are readily ruptured by pressure when they encounter distribution fitting 116 at the lower end of casing 110. The plug used between the chaser fluid and the cement slurry is typically a solid plug which is readily removed from the wellbore by drilling or the like after the cement slurry has been positioned in the annular space.

According to the present invention, a method and tandem spacer fluid formulation have been provided to permit tailored cleaning and conditioning of the drill pipe inner surfaces and also the annular space to sealingly position cement in the annular space. The tandem spacer of the present invention also provides a method for minimizing mixing between cement slurry and drilling fluid during well treatments due to viscosity and density differentials. By contrast to previous methods which use a dispersant to attempt to render the resulting mixture compatible and dispersible, the present invention is directed toward minimizing or avoiding the mixing. While the present invention is considered to minimize mixing between the cement slurry and drilling fluids, the use of a dispersant in combination with the surfactants disclosed herein is also effective. Such dispersants are effective to render the cement slurries and water-based drilling fluids compatible in the event that any mixing should occur. Accordingly, by the present invention, mixing of the cement slurry and the drilling fluids is minimized or avoided and more effective cleaning is provided.

Having thus described the present invention by reference to certain of its preferred embodiments, it is pointed out that the embodiments disclosed are illustrative rather than limiting in nature and that many variations and modifications are possible within the scope of the present invention. Many such variations and modifications may be considered obvious and desirable by those skilled in the art.

I claim:

1. A spacer fluid system for use between a drilling fluid and a cement slurry wherein the drilling fluid has a density at least about 6 ppg less than the density of the cement slurry, the spacer fluid system consisting essentially of:

a) an aqueous lead spacer fluid having a density greater than the density of the drilling fluid from about 0.1 to about 2.0 ppg and a viscosity greater than the drilling fluid and containing from about 0.5 to about 10 weight percent of a surfactant consisting essentially of from about 10 to about 90 mole percent of at least one alkyl polyglycoside containing alkyl groups containing from about 4 to about 20 carbon atoms and having an oligomerization number from 1 to about 12 and from about 90 to about 10 mole percent of at least one ethoxylated alcohol containing alkyl alcohols containing from about 6 to about 16 carbon atoms and from about 2 to about 8 ethylene oxide groups per molecule of alkyl alcohol; and, b) an aqueous tail spacer fluid having a density from about 0.1 to about 2.0 ppg less than the density of the cement slurry and having a viscosity less than the cement slurry and containing from about 0.5 to about 10 weight percent of a surfactant consisting essentially of from about 30 to about 100 mole percent of at least one alkyl polyglycoside containing alkyl groups containing from about 4 to about 20 carbon atoms and having an oligomerization number from about 1 to about 12 and up to about 70 mole percent of at least one ethoxylated alcohol containing alkyl alcohols containing from about 6 to about 16 carbon atoms and from about 2 to about 8 ethylene oxide groups per molecule of alkyl alcohol.

2. The spacer fluid of claim 1 wherein the density of the aqueous lead spacer fluid is from about 0.1 to about 1.0 ppg greater than the density of the drilling fluid.

3. The spacer fluid of claim 1 wherein the density of the aqueous tail spacer fluid is from about 0.1 to about 1.0 ppg less than the density of the cement slurry.

4. The spacer fluid of claim 1 wherein the aqueous lead spacer fluid contains from about 0.5 to about 5.0 weight percent of the surfactant.

5. The spacer fluid of claim 1 wherein the aqueous tail spacer fluid contains from about 0.5 to about 5 weight percent of the surfactant.

* * * * *